US009352587B2

(12) United States Patent
Sasaki

(10) Patent No.: US 9,352,587 B2
(45) Date of Patent: May 31, 2016

(54) LIQUID EJECTING APPARATUS AND LIQUID EJECTION MATERIAL MANUFACTURING METHOD

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/719,197

(22) Filed: May 21, 2015

(65) Prior Publication Data

US 2015/0336404 A1 Nov. 26, 2015

(30) Foreign Application Priority Data

May 22, 2014 (JP) ..... 2014-106193

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
CPC ..... B41J 11/0015
USPC ..... 347/101
See application file for complete search history.

(56) References Cited

U.S. PATENT DOCUMENTS 4,849,786 A * 7/1989 Murakami ..... G03G 15/234 271/3.03
5,500,667 A * 3/1996 Schwiebert ..... B41J 11/002 219/216
5,631,078 A * 5/1997 Ellery ..... B41M 7/0027 428/195.1
5,896,154 A * 4/1999 Mitani ..... B41J 2/1404 347/102
8,651,651 B2 2/2014 Takaku et al.
8,740,374 B2 6/2014 Seno et al.
2001/0015745 A1* 8/2001 Onishi ..... B41J 2/2056 347/101
2002/0060706 A1* 5/2002 Sawano ..... H04N 1/40087 347/15
2003/0132996 A1* 7/2003 Adachi ..... G03G 15/2003 347/102
2006/0066710 A1* 3/2006 Fukui ..... B41J 11/0085 347/139

FOREIGN PATENT DOCUMENTS

JP 2004-209797 7/2004
JP 2004-209798 7/2004
JP 2004-209799 7/2004
JP 2010-005959 1/2010
JP 11/08/2012 11/2012
JP 11/15/2012 11/2012

* cited by examiner

*Primary Examiner* — Stephen Meier
*Assistant Examiner* — Alexander D Shenderov
(74) *Attorney, Agent, or Firm* — Workman Nydegger

(57) ABSTRACT

A liquid ejecting apparatus includes: an elimination unit that includes a contact portion in contact with a medium containing a plasticizer and that eliminates at least a part of the plasticizer; and a liquid ejecting unit that ejects liquid onto the medium from which at least a part of the plasticizer is eliminated by the elimination unit. Here, the contact portion is adapted to contact the entire medium in the intersection direction intersecting the transportation direction of the medium and is formed such that the contact distance with respect to the medium in the transportation direction of the medium is different in the intersection direction and an SP value as a soluble parameter is 8.0 or more and 10.0 or less.

10 Claims, 9 Drawing Sheets

LIQUID EJECTING APPARATUS AND LIQUID EJECTION MATERIAL MANUFACTURING METHOD

BACKGROUND

1. Technical Field

The present invention relates to a liquid ejecting apparatus and a liquid ejection material manufacturing method.

2. Related Art

Hitherto, a liquid ejecting apparatus that ejects liquid onto a medium has been used in the same manner as a recording apparatus that ejects ink onto a target recording medium so as to form an image thereon. For example, JP-A-2010-5959 discloses a recording apparatus that may use a vinyl chloride sheet or a tarpaulin as a target recording medium. The recording apparatus disclosed in JP-A-2010-5959 includes a feeding roller as a driving roller and a pinch roller as a driven roller, and a plurality of pinch rollers are provided at positions facing the feeding roller with a gap therebetween and are adapted to contact a recording surface of the medium.

However, since a plasticizer is contained in a medium such as a vinyl chloride sheet or a tarpaulin, the plasticizer repels ink. As a result, a problem arises in that an image (a liquid ejection material) is not evenly formed on the medium.

As a result of careful examination, the inventors found that the recording apparatus disclosed in JP-A-2010-5959 has a problem in which unevenness in the liquid ejection material occurs in accordance with unevenness (for example, a portion of the medium in contact with the pinch roller and a portion of the medium not in contact with the pinch roller) in a contact distance between the medium and the contact portion in contact with the medium in a transportation direction of the medium.

SUMMARY

An advantage of some aspects of the invention is to suppress occurrence of unevenness in a liquid ejection material in accordance with unevenness in a contact distance between a medium and a contact portion in contact with the medium in a transportation direction of the medium.

According to a first aspect of the invention, provided is a liquid ejecting apparatus including: an elimination unit that includes a contact portion in contact with a medium containing a plasticizer and that eliminates at least a part of the plasticizer; and a liquid ejecting unit that ejects liquid onto the medium from which at least a part of the plasticizer is eliminated by the elimination unit, wherein the contact portion is adapted to contact the entire medium in an intersection direction intersecting a transportation direction of the medium and that is formed such that a contact distance with respect to the medium in the transportation direction of the medium is different in the intersection direction and such that an SP value as a soluble parameter is 8.0 or more and 10.0 or less.

It is preferable that the liquid ejecting apparatus further include a heater that heats the transported medium, wherein the elimination unit eliminate at least a part of the plasticizer moved to a surface of the medium by the heating of the heater.

It is preferable that a ratio of a maximum value of the contact distance with respect to a minimum value thereof be 2 or more and 21 or less.

It is preferable that the elimination unit include a roller row in which a plurality of rollers each including a rotation shaft disposed in the intersection direction and serving as the contact portion are arranged with a gap therebetween parallel to the intersection direction, and a plurality of roller rows are provided in the transportation direction such that the rollers are alternately arranged in the transportation direction.

It is preferable that the liquid ejecting apparatus further include a driving roller that includes a rotation shaft disposed in the intersection direction and that applies a drive force for transporting the medium, wherein at least two roller rows are disposed so as to face the driving roller.

It is preferable that the temperature of the medium heated by the heater be 40° C. or higher.

It is preferable that the elimination unit be adapted to separate the contact portion from the medium when a predetermined time elapses after the transportation of the medium is stopped.

It is preferable that the liquid be an aqueous ink.

It is preferable that a contact angle of the liquid with respect to the medium before the medium comes into contact with the contact portion be 20° or more and 90° or less.

According to another aspect of the invention, provided is a liquid ejection material manufacturing method including: heating a transported medium containing a plasticizer; eliminating at least a part of the plasticizer moved to a surface of the medium by the heating in a manner such that a contact portion, which is adapted to contact the entire medium in an intersection direction intersecting a transportation direction of the medium and which is formed such that a contact distance with respect to the medium in the transportation direction of the medium is different in the intersection direction and an SP value as a soluble parameter is 8.0 or more and 10.0 or less, is made to contact the medium; and ejecting liquid onto the medium subjected to the eliminating.

According to the invention, it is possible to suppress the occurrence of unevenness in a liquid ejection material in accordance with unevenness in the contact distance between a medium and a contact portion in contact with the medium in the transportation direction of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment as a liquid ejecting apparatus of the invention will be described in detail with reference to the accompanying drawings. In addition, the recording apparatus of the embodiment is a recording apparatus that may use a target recording medium containing a plasticizer.

First Embodiment (FIGS. 1 to 5B)

Figure 1:
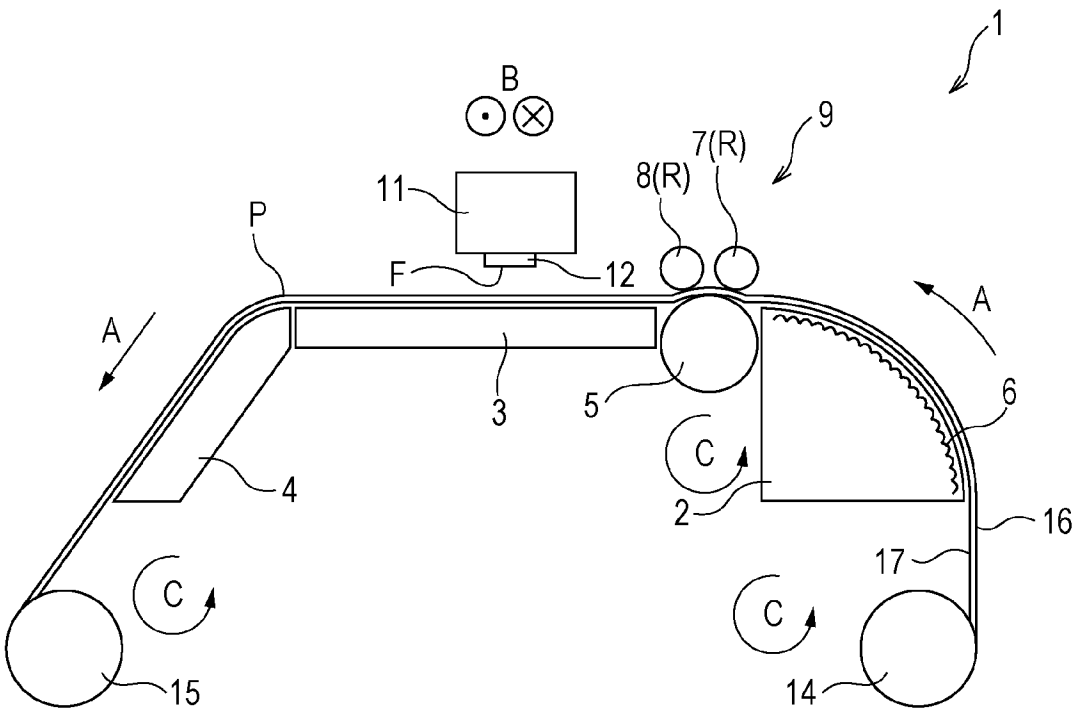
FIG. 1 is a schematic side view showing a recording apparatus according to a first embodiment of the invention.
Figure 2:
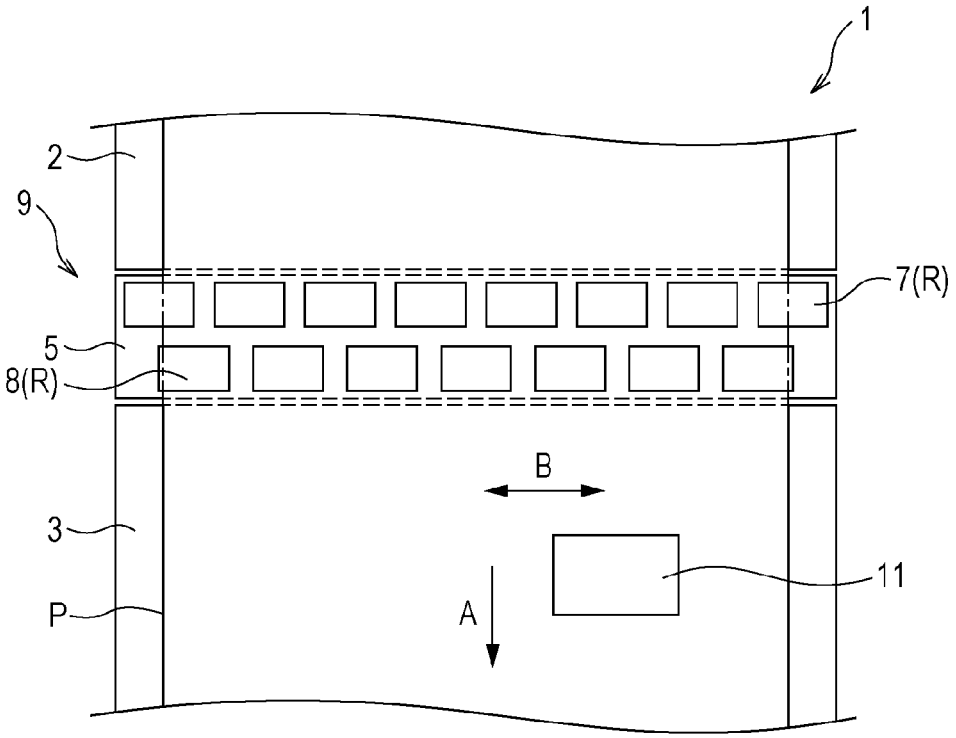
FIG. 2 is a schematic top view showing the recording apparatus according to the first embodiment of the invention.

FIG. 1 is a schematic side view showing a recording apparatus 1 according to a first embodiment of the invention, and FIG. 2 is a schematic top view showing the recording apparatus 1 according to the first embodiment of the invention.

As shown in FIG. 1, the recording apparatus 1 of the embodiment transports a target recording medium P in a transportation direction A from a set portion 14 to a winding portion 15 along platens 2, 3, and 4 serving as support portions for the target recording medium P. That is, a transportation path for the target recording medium P is formed from the set portion 14 to the winding portion 15 in the recording apparatus 1, and the platens 2, 3, and 4 are the support portions for the target recording medium P provided in the transportation path. In addition, the set portion 14 rotates in the rotation direction C so as to supply the target recording medium P therefrom, and the winding portion 15 rotates in the rotation direction C so as to wind the target recording medium P thereon.

In addition, the recording apparatus 1 of the embodiment is configured to perform a recording operation on the target recording medium P having a roll shape, but the invention is not limited to such a configuration. For example, the recording apparatus 1 of the embodiment may be configured to perform a recording operation on the target recording medium P having a single-cut shape. In the configuration in which a recording operation is performed on the target recording medium P having a single-cut shape, for example, a sheet supply (feeding) tray and a sheet supply (feeding) cassette may be used as the set portion 14 for the target recording medium P. Further, for example, a discharge receiving portion, a sheet discharge (discharging) tray, and a sheet discharge (discharging) cassette may be used as a collection portion for the target recording medium P other than the winding portion 15.

In the embodiment, since the target recording medium P having a roll shape and wound so that a recording surface 16 faces the outside is used, the rotation shaft of the set portion 14 rotates in the rotation direction C when the target recording medium P is supplied from the set portion 14. Meanwhile, when the target recording medium P having a roll shape and wound so that the recording surface 16 faces the inside is used, the target recording medium P may be supplied while the rotation shaft of the set portion 14 rotates in a direction opposite to the rotation direction C.

Similarly, since the winding portion 15 of the embodiment winds the target recording medium P so that the recording surface 16 faces the outside, the rotation shaft of the winding portion 15 rotates in the rotation direction C. Meanwhile, when the winding portion 15 of the embodiment winds the target recording medium P so that the recording surface 16 faces the inside, the target recording medium P may be wound while the rotation shaft of the winding portion 15 rotates in a direction opposite to the rotation direction C.

A heater 6 is provided in the platen 2 of the recording apparatus 1 of the embodiment. The heater 6 is provided so as to heat (pre-heat) the target recording medium P before a recording operation is performed by a recording head 9 as a recording unit.

In addition, the recording apparatus 1 of the embodiment is configured to pre-heat the target recording medium P from a surface 17 opposite the recording surface 16 of the target recording medium P by using the heater 6. However, for example, a configuration may be employed in which the target recording medium P is pre-heated from the recording surface 16 by using a heater capable of heating the target recording medium P by irradiating the target recording medium P with infrared rays from the recording surface 16 of the target recording medium P.

The recording apparatus of the embodiment may use the target recording medium P containing a plasticizer. However, the plasticizer may be effectively moved to the surface of the target recording medium P in a manner such that the target recording medium P is heated by the heater 6.

Further, the recording apparatus 1 of the embodiment includes a driving roller 5 which includes a rotation shaft disposed in the intersection direction B intersecting the transportation direction A between the platens 2 and 3 and applies a transportation force to the surface 17 of the target recording medium P.

Roller rows 7 and 8 are provided at the positions facing the driving roller 5. Here, the roller rows 7 and 8 are provided by arranging a plurality of rollers R (driven rollers), each including a rotation shaft disposed in the intersection direction B, with a gap therebetween parallel to the intersection direction B as the contact portions with respect to the target recording medium P. As shown in FIG. 2, the roller rows 7 and 8 are arranged in the transportation direction A so that the rollers R thereof are alternately arranged in the transportation direction A.

The target recording medium P may be pinched between the driving roller 5 and each of the roller rows 7 and 8 which serve as a pair of rollers. With such a configuration, the driving roller 5 and the roller rows 7 and 8 constitute a transportation unit 9. Here, the driven roller indicates a roller which rotates with the transportation of the target recording medium P.

Further, when the target recording medium P is transported in the transportation direction A, the driving roller 5 rotates in the rotation direction C, and the roller rows 7 and 8 rotate in a direction opposite to the rotation direction C.

Further, the roller rows 7 and 8 include the rollers R as the contact portions in contact with the target recording medium P, and serve as elimination units which eliminate at least a part of the plasticizer moved to the surface of the target recording medium P by the heating of the heater 6. The roller R is formed of a material which may absorb the plasticizer of the surface of the target recording medium P. Next, the roller R as the contact portion comes into contact with the entire target recording medium P in the intersection direction B by the roller rows 7 and 8. Therefore, the recording surface 16 of the target recording medium P at the downstream side of the roller rows 7 and 8 in the transportation direction A becomes a state where at least a part of the plasticizer is eliminated by the roller rows 7 and 8 in the entire target recording medium P in the intersection direction B. Accordingly, it is desirable that the roller rows 7 and 8 be provided at the downstream side in the transportation direction A of the target recording medium P in relation to the heater 6.

In addition, various examples such as a plasticizer of phthalate-based, adipate-based, phosphate-based, or trimellitic-based may be used as specific examples of the plasticizer contained in a medium such as the target recording medium P. Among them, particularly, in a plasticizer used in a target recording medium such as a tarpaulin or a vinyl chloride sheet such as that used in the recording apparatus, diethyl phthalate as a plasticizer is known to cause a problem in a liquid ejection material formed on the medium.

Further, the recording apparatus 1 of the embodiment includes a recording head 12 as a liquid ejecting unit provided at the position facing the platen 3 at the downstream side in the transportation direction A in relation to the roller rows 7 and 8. The recording apparatus 1 forms a desired image by ejecting ink from an ink ejection surface F of the recording head 12 onto the target recording medium P while moving the recording head 12 in a reciprocating manner in the intersection direction B through a carriage 11. With such a configuration, the recording head 12 as the liquid ejecting unit may eject ink onto an area from which at least a part of the plasticizer is eliminated by the roller rows 7 and 8 as the elimination unit in the target recording medium P.

In addition, the recording apparatus 1 of the embodiment includes the recording head 12 which performs a recording operation while moving in a reciprocating manner. However, the recording apparatus may include a so-called line head in which a plurality of nozzles ejecting ink are provided in the intersection direction B intersecting the transportation direction A.

Here, the "line head" indicates a recording head which is used in the recording apparatus and in which an area of nozzles formed in the intersection direction B intersecting the transportation direction A of the target recording medium P covers the entire target recording medium P in the intersection direction B and an image is formed by the relative movement of the recording head or the target recording medium P. In addition, the area of the nozzles in the intersection direction B of the line head may not cover the entire target recording medium P to be treated by the recording apparatus in the intersection direction B.

Next, an electrical configuration of the recording apparatus 1 of the embodiment will be described.

Figure 3:
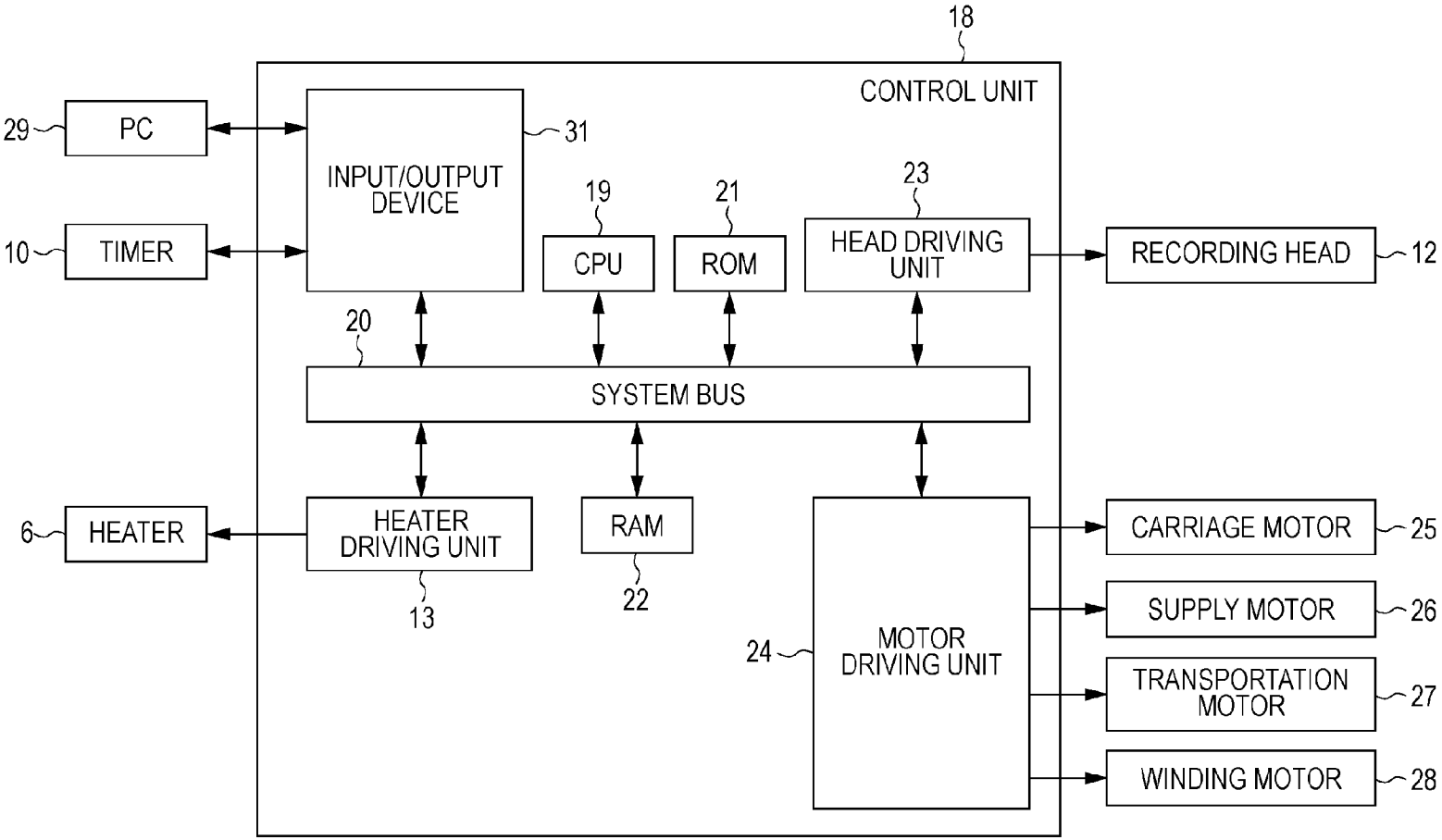
FIG. 3 is a block diagram showing the recording apparatus according to the first embodiment of the invention.

FIG. 3 is a block diagram of the recording apparatus 1 of the embodiment.

A control unit 18 is equipped with a CPU 19 that controls the entire recording apparatus 1. The CPU 19 is connected to a ROM 21 that stores maintenance sequences or various control programs executed by the CPU 19 and a RAM 22 that temporarily stores data via a system bus 20.

Further, the CPU 19 is connected to a head driving unit 23 that drives the recording head 12 via the system bus 20.

Further, the CPU 19 is connected to a motor driving unit 24 that drives a carriage motor 25 moving the carriage 11, a supply motor 26 serving as a drive source for the set portion 14, a transportation motor 27 serving as a drive source for the driving roller 5, and a winding motor 28 serving as a drive source for the winding portion 15 via the system bus 20.

Further, the CPU 19 is connected to a heater driving unit 13 driving the heater 6 via the system bus 20.

In addition, the CPU 19 is connected to an input/output device 31 via the system bus 20, and the input/output device 31 is connected to a timer 10 and a PC 29 as an external device that inputs recording data to the recording apparatus 1.

With such a configuration, the control unit 18 controls the respective components of the recording apparatus 1. For example, the control unit 18 controls the recording head 12 so that ink is ejected onto an area from which a part of the plasticizer is eliminated by the roller rows 7 and 8 as the elimination units in the target recording medium P.

Here, as described above, the recording apparatus 1 of the embodiment includes the heater 6, which heats the transported target recording medium P, and the roller rows 7 and 8, which include the rollers R in contact with the target recording medium P containing the plasticizer, and eliminate at least a part of the plasticizer moved to the surface of the target recording medium P by the heating of the heater 6. The recording apparatus 1 is configured to form an image on the target recording medium P by ejecting ink as liquid from the recording head 12 onto the target recording medium P from which at least a part of the plasticizer is eliminated by the roller rows 7 and 8.

Here, as shown in FIG. 2, the rollers R of the roller rows 7 and 8 are provided to come into contact with the entire target recording medium P in the intersection direction B and are formed so that the contact distance with respect to the target recording medium P in the transportation direction A is different in the intersection direction B.

Further, in each of the rollers R of the roller rows 7 and 8, a portion that comes into contact with the target recording medium P is formed of a material of which an SP value as a soluble parameter is 8.0 or more and 10.0 or less.

Here, the "contact with respect to the entire target recording medium P in the intersection direction B" includes a configuration in which a plurality of contact portions are arranged in the intersection direction B or a configuration in which a plurality of contact portions are arranged in the intersection direction B and the transportation direction A as in the embodiment other than a configuration in which one contact portion comes into contact with the entire target recording medium P in the intersection direction B.

Further, the "contact distance with respect to the target recording medium P in the transportation direction A" indicates the length in the transportation direction A in the case where the contact portion with respect to the target recording medium P comes into contact with the surface of the target recording medium P. However, in the case where the contact portion (the roller R) comes into contact with the arc surface of the target recording medium P as in the embodiment, the contact distance indicates the circumferential length of the arc. Further, in the case where a plurality of contact portions are disposed in the transportation direction, the contact distance indicates the total length.

A specific example of the "contact distance with respect to the target recording medium P in the transportation direction A" will be described with reference to FIG. 4 as a schematic diagram showing a main configuration of the recording apparatus 1 of the embodiment. Any roller R of the embodiment is formed in a columnar shape. Here, the circumferential length of the roller R of the roller row 7 is constant at the value of L1, and the circumferential length of the roller R of the roller row 8 is constant at the value of L2. Therefore, the "contact distance with respect to the target recording medium P in the transportation direction A" at a portion P1 in which the roller of the roller row 7 overlaps the roller R of the roller row 8 in the transportation direction A becomes the sum of the "circumferential length L1 of a portion P1*a*" and the "circumferential length L2 of a portion P1*b*". Meanwhile, the "contact distance with respect to the target recording medium P in the transportation direction A" at a portion P2 in which the roller R of the roller row 7 does not overlap the roller R of the roller row 8 in the transportation direction A becomes the "circumferential length L1 of the portion P2".

Further, there is a tendency for most of the plasticizer contained in the target recording medium P to have a high SP value of 10 or more. Here, the plasticizer is absorbed more easily by the contact portion as the SP value of the plasticizer becomes substantially equal to the SP value of the contact portion with respect to the target recording medium P.

Therefore, in the recording apparatus 1 including the contact portion adapted to contact the entire target recording medium P in the intersection direction B and formed so that the contact distance with respect to the target recording medium P in the transportation direction A is different in the intersection direction B, when the SP value of the contact portion is too high, too much of the plasticizer is eliminated at the portion having a long contact distance, and hence unevenness occurs in the target recording medium P. That is, the unevenness due to plasticizer elimination increases between the portion having a long contact distance and the portion having a short contact distance, and hence unevenness occurs easily in the target recording medium P. Meanwhile, in the recording apparatus 1 including the contact portion adapted to contact the entire target recording medium P in the intersection direction B and formed so that the contact distance with respect to the target recording medium P in the transportation direction A is different in the intersection direction B, when the SP value of the contact portion is too low, the plasticizer is not eliminated. In this case, a problem arises in that ink is repelled by the plasticizer. That is, since the plasticizer is not eliminated, ink is repelled in the entire target recording medium P, and hence the ink dot diameter becomes smaller than a predetermined size. As a result, a problem may arise in that the image quality is not satisfactory.

The rollers R of the roller rows 7 and 8 as the contact portions of the embodiment contact the entire target recording medium P in the intersection direction B and the SP values thereof are 8.0 or more and 10.0 or less. Therefore, it is possible to eliminate the plasticizer of the target recording medium P without any unevenness occurring in the intersection direction B and to suppress the occurrence of unevenness in the liquid ejection material (the image forming material).

Table 1 below shows rubber materials which may be used as the contact portion with respect to the target recording medium P and the SP values thereof.

TABLE 1

| Material type | SP value |
|---|---|
| Natural rubber | 7.9 to 8.4 |
| Isoprene rubber | 7.9 to 8.4 |
| Styrene-butadiene rubber | 8.1 to 8.7 |
| Butadiene rubber | 8.1 to 8.6 |
| Chloroprene rubber | 8.2 to 9.4 |
| Butyl rubber | 7.7 to 8.1 |
| Ethylene-propylene rubber | 7.9 to 8.0 |
| Ethylene-vinyl acetate copolymer | 7.8 to10.6 |
| Chlorosulphonated polyethylene | 8.1 to10.6 |
| Chlorinated polyethylene | 8.6 to 8.8 |
| Epichlorohydrin rubber | 9.6 to 9.8 |
| Nitrile butadiene rubber | 8.7 to10.5 |
| Nitrile isoprene rubber | 9.9 |
| Acrylic rubber | 9.4 |
| Urethane rubber | 10.0 |
| Polysulfide rubber | 9.0 to 9.4 |
| Silicone rubber | 7.3 to 7.6 |
| Fluoro rubber | 8.6 |

Further, it is desirable that the ratio of the maximum value of the contact distance with respect to the minimum value thereof be 2 or more and 21 or less. In this range, the plasticizer of the target recording medium P may be particularly eliminated in the intersection direction B without any unevenness occurring and the occurrence of unevenness in the liquid ejection material may be particularly suppressed.

Further, as described above, the elimination unit for the plasticizer of the target recording medium P of the embodiment includes the roller rows 7 and 8 in which the rollers R each including a rotation shaft disposed in the intersection direction B are arranged with a gap therebetween in the intersection direction B, and the roller rows 7 and 8 as the roller rows are arranged parallel to the transportation direction A so that the rollers R are alternately arranged in the transportation direction A. With such a configuration, the entire target recording medium P and the roller R simply contact each other in the intersection direction B. In a configuration in which one roller R is provided so as to contact the entire target recording medium P in the intersection direction B, it is difficult to ensure the rigidity of the rotation shaft (the support portion) of the roller R.

Further, as shown in FIGS. 1 and 2, the recording apparatus 1 of the embodiment includes the driving roller 5 which includes a rotation shaft disposed in the intersection direction B and applies a drive force for transporting the target recording medium P to the target recording medium P, and the roller rows 7 and 8 as at least two or more roller rows are disposed so as to face the driving roller 5.

With such a configuration, the target recording medium P may be pinched between the driving roller 5 and each of two or more roller rows. Accordingly, a large press-contact area of the target recording medium P with respect to the driving roller 5 may be ensured, and hence the transportation precision may be improved.

A specific example of the "configuration in which the target recording medium P is pinched between the driving roller 5 and each of two or more roller rows and a large press-contact area of the target recording medium P with respect to the driving roller 5 is ensured" will be described with reference to FIGS. 5A and 5B as schematic diagrams showing a main configuration of the recording apparatus 1 of the embodiment.

Figure 5A:
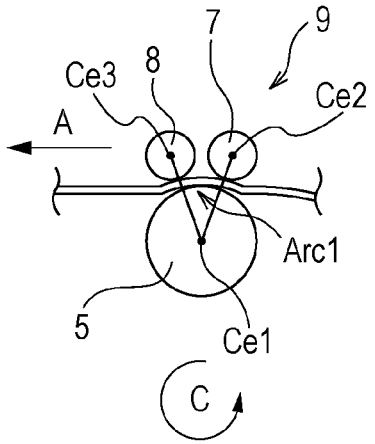
FIGS. 5A and 5B are schematic diagrams showing a main configuration of the recording apparatus according to the first embodiment of the invention.

FIG. 5A shows a configuration of the embodiment. In this configuration, the "target recording medium P is pinched between the driving roller 5 and each of two or more roller rows". In such a configuration, the target recording medium P may be pressed against the driving roller 5 in the range of a circular arc Arc1 from the intersection point between the line connecting the rotation center Ce1 of the driving roller 5 and the rotation center Ce2 of the roller row 7 and the circular arc of the driving roller 5 to the intersection point between the line connecting the rotation center Ce1 of the driving roller 5 and the rotation center Ce3 of the roller row 8 and the circular arc of the driving roller 5.

Figure 5B:
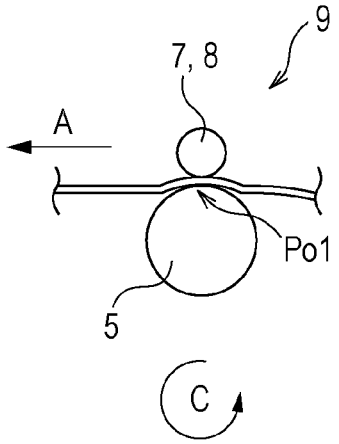

Meanwhile, in the configuration in which one roller row 7 or 8 is provided for the driving roller 5 as shown in FIG. 5B, the target recording medium P is pressed against the driving roller 5 at one point Po1 of the circular arc.

Further, it is desirable that the outer diameter of each of the rollers R of the roller rows 7 and 8 be 4 mm or larger. When the outer diameter of the roller R is set to be 4 mm or larger, it is possible to eliminate the plasticizer of the target recording medium P without any unevenness occurring in the intersection direction B and to transport the medium with high precision.

In addition, it is desirable that the outer diameter of each of the rollers R of the roller rows 7 and 8 be 40 mm or smaller from the viewpoint of the upper limit of the desirable size when the rollers are mounted on the recording apparatus 1.

Further, it is desirable that the temperature of the target recording medium P heated by the heater 6 be 40° C. or higher. When the heating temperature of the target recording medium P is equal to or higher than 40° C., it is possible to effectively move the plasticizer to the surface of the target recording medium P and to effectively eliminate the plasticizer without any unevenness occurring.

As shown in FIG. 3, the recording apparatus 1 of the embodiment includes the timer 10.

Then, when a predetermined time elapses after the transportation of the target recording medium P is stopped by the control of the control unit 18, the roller rows 7 and 8 are moved by a movement mechanism (not shown) for the roller rows 7 and 8 so that the rollers R of the roller rows 7 and 8 are separated from the target recording medium P.

Since the rollers R continuously contact a part of the target recording medium P for a time exceeding a predetermined time, the unevenness due to plasticizer elimination may be suppressed.

Further, the ink used in the recording apparatus 1 of the embodiment is an aqueous ink. Particularly, the aqueous ink easily causes unevenness to occur in the liquid ejection material during image forming when the plasticizer is not evenly distributed in the target recording medium P. However, the recording apparatus 1 of the embodiment is configured to suppress the occurrence of unevenness in the liquid ejection material even when the liquid ejected from the recording head 12 is the aqueous ink.

In addition, the ink used in the recording apparatus 1 of the embodiment is an aqueous ink that uses water as a main solvent. However, for example, a solvent ink using an organic solvent as a main solvent may be used.

In the case where the liquid ejected from the recording head 12 is an aqueous ink, for example, ethylene-propylene rubber, urethane, fluoro rubber, and an elastomer may be desirably used. However, in the case where the liquid ejected from the recording head 12 is a solvent ink, it is desirable to use ethylene-propylene rubber, urethane, and fluoro rubber since elastomers have a weak resistance with respect to the solvent ink.

Further, in the case where the contact angle of the liquid ejected from the recording head 12 with respect to the target recording medium P is 20° or more and 90° or less before the rollers R of the roller rows 7 and 8 contact the target recording medium P, the configuration of the embodiment is particularly desirable.

In the case where the contact angle of the liquid with respect to the target recording medium P is 20° or more and 90° or less before the contact portion comes into contact with the target recording medium P, unevenness in the liquid ejection material occurs particularly easily. However, even in the case where the contact angle of the liquid with respect to the target recording medium P is 20° or more and 90° or less before the contact portion comes into contact with the target recording medium P, it is possible to suppress unevenness occurring in the liquid ejection material by using the configuration of the embodiment.

In addition, the contact portion with respect to the target recording medium P corresponding to the rollers R of the roller rows 7 and 8 of the embodiment is not particularly limited when the SP value is 8.0 or more and 10.0 or less, and high saturation absorptivity is desirable. When the saturation absorptivity is high, the plasticizer may be sufficiently absorbed from the target recording medium P, and hence most of the plasticizer absorbed by the contact portion is gradually dispersed into the atmosphere. Accordingly, the recording apparatus may be used for a long time.

Figure 6:
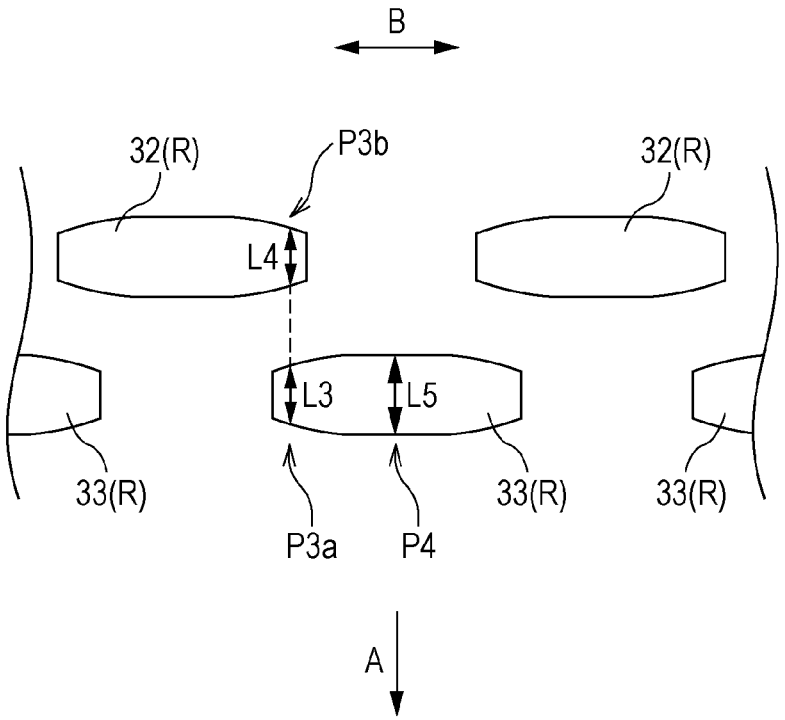
FIG. 6 is a schematic diagram showing a main configuration of a recording apparatus according to a second embodiment of the invention.

Second Embodiment (FIG. 6)

Next, a recording apparatus of a second embodiment will be described in detail with reference to the accompanying drawings.

Figure 4:
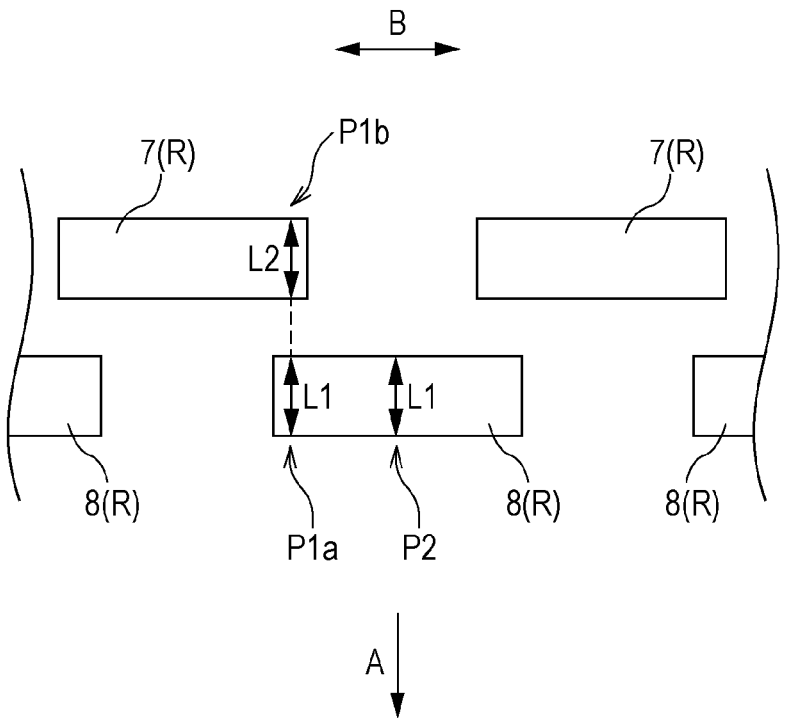
FIG. 4 is a schematic diagram showing a main configuration of the recording apparatus according to the first embodiment of the invention.

FIG. 6 is a schematic diagram showing a main configuration of the recording apparatus 1 of the embodiment, and is a diagram corresponding to FIG. 4 showing a main configuration of the recording apparatus 1 of the first embodiment. In addition, the same components as those of the first embodiment will be indicated by the same reference signs, and a detailed description thereof is omitted.

In addition, the recording apparatus 1 of the embodiment has the same configuration as the recording apparatus 1 of the first embodiment except that the elimination units are provided as roller rows 32 and 33 in which a plurality of rollers R each having a shape different from that of the rollers R of the roller rows 7 and 8 are provided with a gap therebetween in the intersection direction B instead of the roller rows 7 and 8.

As shown in FIG. 6, any one of the rollers R provided in the roller rows 32 and 33 is formed so that both ends in the intersection direction B are thinner than the center in the intersection direction B. Therefore, a difference between the sum of the "circumferential length L3 of a portion P3*a*" and the "circumferential length L4 of a portion P3*b*" as the "contact distance with respect to the target recording medium P in the transportation direction A" at a portion P3 in which the roller R of the roller row 32 overlaps the roller R of the roller row 33 in the transportation direction A and the "circumferential length L5 of a portion P2" as the "contact distance with respect to the target recording medium P in the transportation direction A" at a portion P4 in which the roller R of the roller row 7 does not overlap the roller R of the roller row 8 in the transportation direction A becomes smaller than that of the recording apparatus 1 of the first embodiment. Here, the sum of the "circumferential length L3 of the portion P3*a*" and the "circumferential length L4 of the portion P3*b*" is longer than the "circumferential length L5 of the portion P2".

In this way, when the shape of the contact portion with respect to the target recording medium P is changed so as to adjust the "contact distance with respect to the target recording medium P in the transportation direction A" in the contact portion, it is possible to effectively suppress unevenness occurring in the liquid ejection material.

Figure 7:
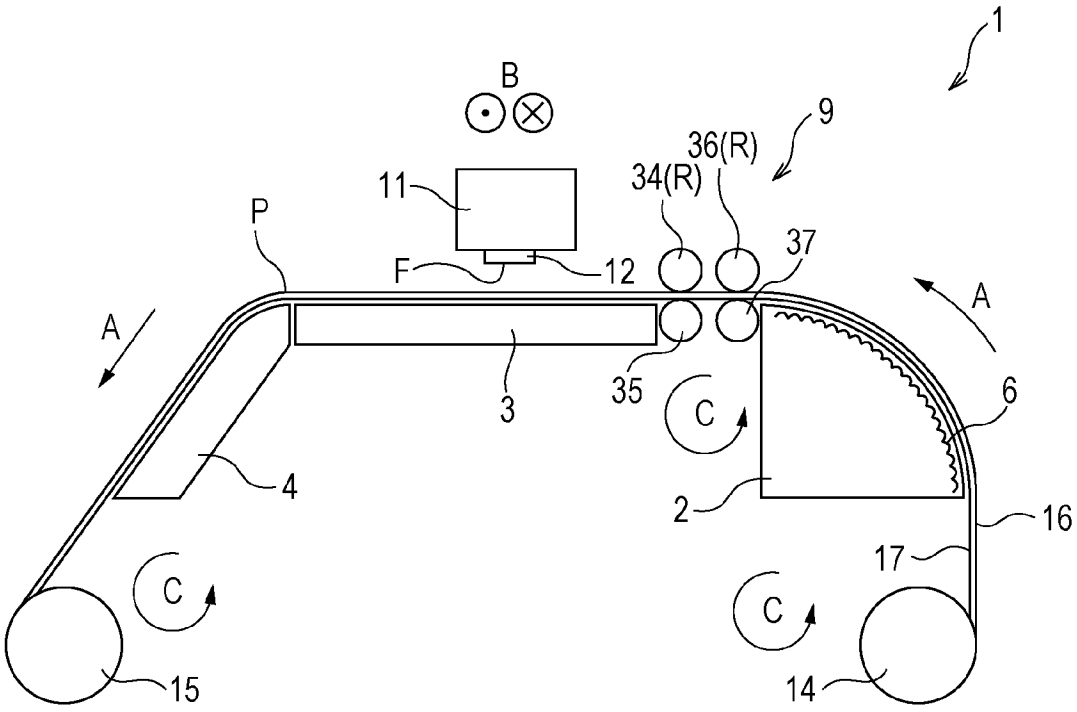
FIG. 7 is a schematic side view showing a recording apparatus according to a third embodiment of the invention.
Figure 8:
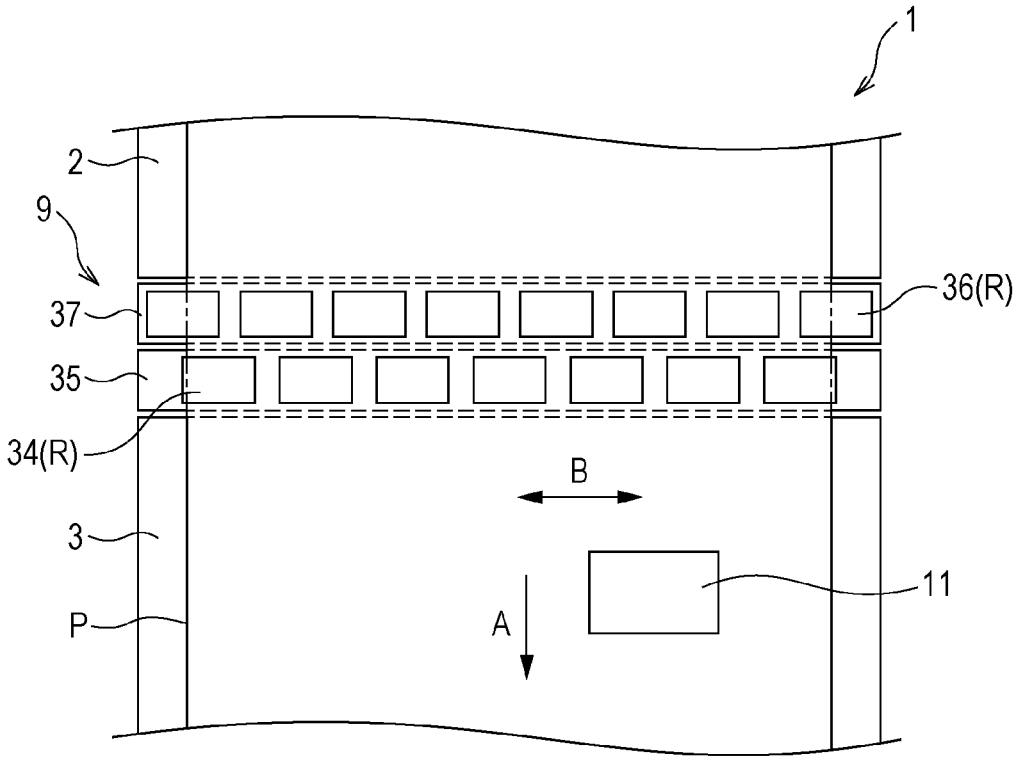
FIG. 8 is a schematic top view showing the recording apparatus according to the third embodiment of the invention.

Third Embodiment (FIGS. 7 and 8)

Next, a recording apparatus of a third embodiment will be described in detail with reference to the accompanying drawings.

FIG. 7 is a schematic side view showing the recording apparatus 1 of the embodiment, and FIG. 8 is a schematic top view showing the recording apparatus 1 of the embodiment. In addition, the same components as those of the first and second embodiments will be indicated by the same reference signs, and a detailed description thereof is omitted.

In addition, the recording apparatus 1 of the embodiment has the same configuration as the recording apparatus 1 of the first embodiment except that a plurality of pairs of rollers are provided such that a pair of rollers including a driving roller 37 and a roller row 36 having the same configuration as the roller row 7 are provided and a pair of rollers including a driving roller 35 and a roller row 34 having the same configuration as the roller row 8 are provided instead of the roller rows 7 and 8 facing one driving roller 5.

In the configuration in which a plurality of roller rows face one driving roller as in the recording apparatus of the first embodiment, the size of the driving roller with respect to the roller row needs to be increased. However, the configuration of the embodiment may be employed in the case where such a configuration is difficult due to the configuration of the apparatus.

Figure 9:
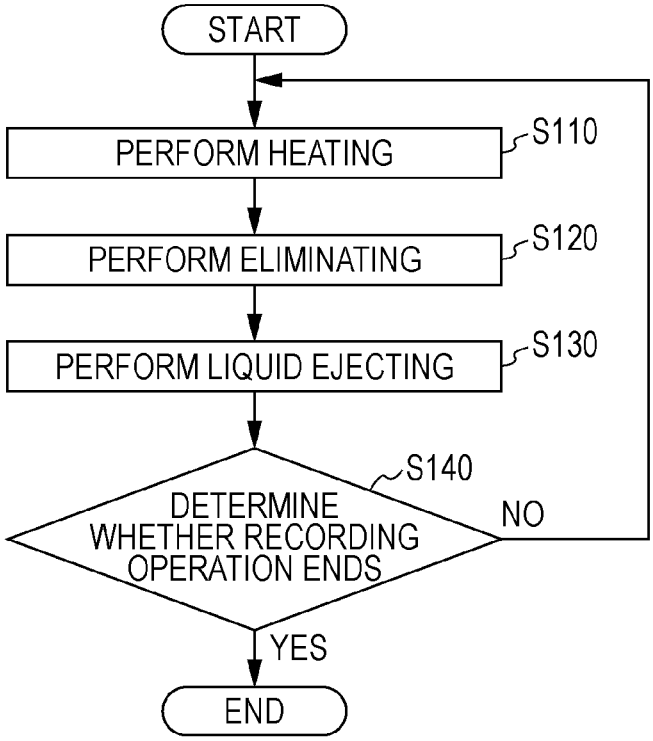
FIG. 9 is a flowchart showing a liquid ejection material manufacturing method according to an embodiment of the invention.

Embodiment of Liquid Ejection Material Manufacturing Method (FIG. 9)

Next, an embodiment of a liquid ejection material manufacturing method using the recording apparatus 1 of the first embodiment will be described.

FIG. 9 is a flowchart of a liquid ejection material manufacturing method of the embodiment.

When the liquid ejection material manufacturing method of the embodiment is started by inputting recording data from the PC 29, the target recording medium P is first heated by the heater 6 by a heating in step S110. In this way, the plasticizer is moved to the surface of the target recording medium P.

Next, at least a part of the plasticizer moved to the surface of the target recording medium P by the heating of the heater 6 is eliminated from the target recording medium P by the roller rows 7 and 8 as the elimination unit by an eliminating in step S120.

Next, ink is ejected by a liquid ejecting in step S130 from the recording head 12 onto an area from which at least a part of the plasticizer is eliminated by the eliminating in step S120 in the target recording medium P.

Then, the processes from step S110 to step S140 are repeated until a recording operation based on the recording data is ended by step S140.

That is, the liquid ejection material manufacturing method of the embodiment includes: heating the transported target recording medium P containing the plasticizer; eliminating at least a part of the plasticizer moved to the surface of the target recording medium P by the heating in a manner such that the rollers R of the roller rows 7 and 8, which are adapted to contact the entire target recording medium P in the intersection direction B and are formed so that the contact distance with respect to the target recording medium P in the transportation direction A is different in the intersection direction B and the SP values as soluble parameters are 8.0 or more and 10.0 or less, are made to contact the target recording medium P; and ejecting ink as liquid onto the target recording medium P subjected to the eliminating. With such a method, the occurrence of unevenness in the liquid ejection material is suppressed.

In addition, the invention is not limited to the above-described embodiments, and various modifications may be made within the scope of claims. Needless to mention, these modifications are also included in the scope of the claims.

As described above, the invention has been described based on the embodiments. Here, the invention will be described again with reference to the recording apparatus 1 of the first embodiment.

According to a first aspect of the invention, provided is the liquid ejecting apparatus 1 including: elimination units 7 and 8 that include contact portions R in contact with a medium P containing a plasticizer and that eliminate at least a part of the plasticizer; and a liquid ejecting unit 12 that ejects liquid onto the medium P from which at least a part of the plasticizer is eliminated by the elimination units 7 and 8. Here, the contact portions R are adapted to contact the entire medium P in an intersection direction B intersecting a transportation direction A of the medium P and that are formed such that a contact distance with respect to the medium P in the transportation direction A of the medium P is different in the intersection direction B and an SP value as a soluble parameter is 8.0 or more and 10.0 or less.

Here, the "configuration in which the contact portion R comes into contact with the entire medium P in the intersection direction B intersecting the transportation direction A of the medium P" includes a configuration in which a plurality of contact portions are arranged in the intersection direction B or a configuration in which a plurality of contact portions are arranged in the intersection direction B and the transportation direction A other than a configuration in which one contact portion comes into contact with the target recording medium P in the intersection direction B.

Further, in the case where the contact portion R comes into contact with a surface of the medium P, the "contact distance with respect to the medium P in the transportation direction A" indicates the length of the surface in the transportation direction A. Meanwhile, in the case where the contact portion R comes into contact with the arc surface of the medium P, the "contact distance with respect to the medium P in the transportation direction A" indicates the circumferential length of the arc. Further, in the case where a plurality of contact portions R are disposed in the transportation direction A, the contact distance indicates the total length.

According to the aspect, the contact portion R comes into contact with the entire medium P in the intersection direction B intersecting the transportation direction A of the medium P and the SP value is 8.0 or more and 10.0 or less. As a result of careful examination, the inventors found that the plasticizer of the medium P may be eliminated without any unevenness occurring in the intersection direction B when the contact portion R in contact with the entire medium P in the intersection direction B and having an SP value of 8.0 or more and 10.0 or less is used. Therefore, according to the aspect, existing unevenness in the liquid ejection material may be suppressed.

According to a second aspect of the invention, provided is the liquid ejecting apparatus 1 of the first aspect further including a heater that heats the transported medium. Here, the elimination unit eliminates at least a part of the plasticizer moved to the surface of the medium by the heating of the heater.

According to the aspect, the heater 6 is provided. Therefore, the plasticizer may be effectively moved to the surface of the medium P.

According to a third aspect of the invention, provided is the liquid ejecting apparatus 1 of the first or second aspect. Here, a ratio of a maximum value of the contact distance with respect to a minimum value thereof is 2 or more and 21 or less.

According to the aspect, a ratio of the maximum value of the contact distance with respect to the minimum value thereof is 2 or more and 21 or less. As a result of careful examination, the inventors found that the plasticizer of the medium P may be eliminated without any unevenness occurring in the intersection direction B particularly in such a range. According to the aspect, existing unevenness in the liquid ejection material may be particularly suppressed.

According to a fourth aspect of the invention, provided is the liquid ejecting apparatus 1 of any one of the first to third aspects, the elimination units 7 and 8 include roller rows 7 and 8 in which the rollers R serving as the contact portions R each including a rotation shaft disposed in the intersection direction B are arranged with a gap therebetween parallel to the intersection direction B, and a plurality of roller rows 7 and 8 are provided in the transportation direction A such that the rollers R are alternately arranged in the transportation direction A.

According to the aspect, the elimination units 7 and 8 include roller rows 7 and 8 in which the rollers R as the contact portions R each including a rotation shaft disposed in the intersection direction B are arranged with a gap therebetween parallel to the intersection direction B, and a plurality of roller rows 7 and 8 are provided in the transportation direction A so that the rollers R are alternately arranged in the transportation direction A. With such a configuration, the contact portion R may simply contact the entire medium P in the intersection direction B.

According to a fifth aspect of the invention, provided is the liquid ejecting apparatus 1 of the fourth aspect further including a driving roller 5 that includes a rotation shaft disposed in the intersection direction B and that applies a drive force for transporting the medium P. Here, at least two roller rows 7 and 8 are disposed so as to face the driving roller 5.

According to the aspect, at least two or more roller rows 7 and 8 are disposed so as to face the driving roller 5. With such a configuration, the medium P may be pinched between the driving roller 5 and each of two or more roller rows 7 and 8. Accordingly, a large press-contact area of the medium P with respect to the driving roller 5 may be ensured, and hence the transportation precision may be improved.

According to a sixth aspect of the invention, provided is the liquid ejecting apparatus 1 of any one of the first to fifth aspects. Here, the temperature of the medium P heated by the heater 6 is 40° C. or higher.

According to the aspect, the temperature of the medium P heated by the heater 6 is equal to or higher than 40° C. When the heating temperature of the medium P is equal to or higher than 40° C., the plasticizer may be effectively moved to the surface of the medium P, and hence the plasticizer may be effectively eliminated without any unevenness occurring.

According to a seventh aspect of the invention, provided is the liquid ejecting apparatus 1 of any one of the first to sixth aspects. Here, the elimination units 7 and 8 are adapted to separate the contact portion R from the medium P when a predetermined time elapses after the transportation of the medium P is stopped.

According to the aspect, the elimination units 7 and 8 are adapted to separate the contact portion R from the medium P when a predetermined time elapses after the transportation of the medium P is stopped. Therefore, it is possible to suppress the unevenness due to plasticizer elimination caused when the contact portion R continuously comes into contact with a part of the medium P for a time exceeding a predetermined time.

According to an eighth aspect of the invention, provided is the liquid ejecting apparatus 1 of any one of the first to seventh aspects. Here, the liquid is an aqueous ink.

According to the aspect, the liquid is the aqueous ink. Particularly, the aqueous ink easily causes image forming unevenness to occur in the liquid ejection material when the plasticizer is not evenly distributed in the medium P. However, even when the liquid is the aqueous ink, the occurrence of unevenness in the liquid ejection material may be suppressed.

According to a ninth aspect of the invention, provided is the liquid ejecting apparatus 1 of any one of the first to eighth aspects. Here, a contact angle of the liquid with respect to the medium P before the medium P comes into contact with the contact portion R is 20° or more and 90° or less.

According to the aspect, the contact angle of the liquid with respect to the medium P before the medium P comes into contact with the contact portion R is 20° or more and 90° or less. When the contact angle of the liquid with respect to the medium P before the medium P comes into contact with the contact portion R is 20° or more and 90° or less, unevenness in the liquid ejection material occurs particularly easily. However, even when the contact angle of the liquid with respect to the medium P before the medium P comes into contact with the contact portion R is 20° or more and 90° or less, the occurrence of unevenness in the liquid ejection material may be suppressed.

According to a tenth aspect of the invention, provided is a liquid ejection material manufacturing method including: heating a transported medium P containing a plasticizer; eliminating at least a part of the plasticizer moved to a surface of the medium P by the heating in a manner such that a contact portion R, which is adapted to contact the entire medium P in an intersection direction B intersecting a transportation direction A of the medium P and is formed such that a contact distance with respect to the medium P in the transportation direction A of the medium P is different in the intersection direction B and an SP value as a soluble parameter is 8.0 or more and 10.0 or less, is made to contact the medium P; and ejecting liquid onto the medium P subjected to the eliminating.

According to the aspect, the contact portion R comes into contact with the entire medium P in the intersection direction B intersecting the transportation direction A of the medium P and has an SP value of 8.0 or more and 10.0 or less. As a result of careful examination, the inventors found that the plasticizer of the medium P may be eliminated without any unevenness occurring in the intersection direction B when the contact portion R in contact with the entire medium P in the intersection direction B and having an SP value of 8.0 or more and 10.0 or less is used. According to the aspect, the occurrence of unevenness in the liquid ejection material may be suppressed.

The entire disclosure of Japanese Patent Application No. 2014-106193, filed May 22, 2014 is expressly incorporated by reference herein.

What is claimed is:

1. A liquid ejecting apparatus comprising:

an elimination unit that includes a contact portion in contact with a medium containing a plasticizer and that eliminates at least a part of the plasticizer; and a liquid ejecting unit that ejects liquid onto the medium from which at least a part of the plasticizer is eliminated by the elimination unit, wherein the contact portion of the elimination unit is adapted to contact the entire medium in an intersection direction intersecting a transportation direction of the medium, wherein the contact portion is formed such that a contact distance with respect to the medium over which the contact portion contacts the medium in the transportation direction of the medium is different in the intersection direction at different positions in the intersection direction and such that a Hildebrand SP value of the contact portion as a soluble parameter is 8.0 or more and 10.0 or less.

2. The liquid ejecting apparatus according to claim 1, further comprising:

a heater that heats the transported medium, wherein the elimination unit eliminates at least a part of the plasticizer moved to a surface of the medium by the heating of the heater.

3. The liquid ejecting apparatus according to claim 1, wherein a ratio of a maximum value of the contact distance with respect to a minimum value thereof is 2 or more and 21 or less.

4. The liquid ejecting apparatus according to claim 1, wherein the elimination unit includes a roller row in which a plurality of rollers each including a rotation shaft disposed in the intersection direction and serving as the contact portion are arranged with a gap therebetween parallel to the intersection direction, and a plurality of roller rows are provided in the transportation direction such that the rollers are alternately arranged in the transportation direction.

5. The liquid ejecting apparatus according to claim 4, further comprising:

a driving roller that includes a rotation shaft disposed in the intersection direction and that applies a drive force for transporting the medium, wherein at least two roller rows are disposed so as to face the driving roller.

6. The liquid ejecting apparatus according to claim 1, wherein the temperature of the medium heated by the heater is 40° C. or higher.

7. The liquid ejecting apparatus according to claim 1, wherein the elimination unit is adapted to separate the contact portion from the medium when a predetermined time elapses after the transportation of the medium is stopped.

8. The liquid ejecting apparatus according to claim 1, wherein the liquid is an aqueous ink.

9. The liquid ejecting apparatus according to claim 1, wherein a contact angle of the liquid with respect to the medium before the medium comes into contact with the contact portion is 20° or more and 90° or less.

10. A liquid ejection material manufacturing method comprising:

heating a transported medium containing a plasticizer;

eliminating at least a part of the plasticizer moved to a surface of the medium by the heating with contact portion that is adapted to contact the entire medium in an intersection direction intersecting a transportation direction of the medium and that is formed such that a contact distance with respect to the medium in the transportation direction of the medium is different in the intersection direction, wherein a Hildebrand SP value of the contact portion as a soluble parameter is 8.0 or more and 10.0 or less, is made to contact the medium; and ejecting liquid onto the medium from which the plasticizer has been eliminated.

* * * * *